US009204671B1

(12) United States Patent
Kessler, III

(10) Patent No.: US 9,204,671 B1
(45) Date of Patent: Dec. 8, 2015

(54) PLACKET STIFFENER ARRANGEMENT FOR A GARMENT SUCH AS A SHIRT

(71) Applicant: Million Dollar Collar, LLC, Milwaukee, WI (US)

(72) Inventor: Robert R. Kessler, III, Milwaukee, WI (US)

(73) Assignee: Million Collar Collar, LLC, Marina Del Rey, CA (US)

( * ) Notice: Subject to any disclaimer, the term of this patent is extended or adjusted under 35 U.S.C. 154(b) by 0 days.

(21) Appl. No.: 14/277,955

(22) Filed: May 15, 2014

Related U.S. Application Data

(60) Provisional application No. 61/890,929, filed on Oct. 15, 2013.

(51) Int. Cl.
*A41B 1/20* (2006.01)
*A41B 3/06* (2006.01)
*A41B 1/08* (2006.01)

(52) U.S. Cl.
CPC ... *A41B 1/20* (2013.01); *A41B 1/08* (2013.01); *A41B 3/06* (2013.01)

(58) Field of Classification Search
CPC ..... A41B 1/02; A41B 1/14; A41B 1/20; A41B 3/06; A41B 3/08; A41B 1/08; A41D 27/06; A41D 1/02
USPC ..... 2/132, 266, 120, 115, 128, 255, 265, 2/134, 257
See application file for complete search history.

(56) References Cited

U.S. PATENT DOCUMENTS

| | | | | |
|---|---|---|---|---|
| 232,696 | A | 9/1880 | Devereux | |
| 560,085 | A | 5/1896 | Determan | |
| 575,839 | A | 1/1897 | Jaberg | |
| 668,918 | A | 2/1901 | Hess | |
| 791,841 | A * | 6/1905 | Troxell | 2/98 |
| 1,498,496 | A * | 6/1924 | Wald | 2/131 |
| 1,943,885 | A * | 1/1934 | Blue | 2/115 |
| 1,959,598 | A * | 5/1934 | Rubel | 2/132 |
| 1,963,174 | A * | 6/1934 | Oathout | 112/408 |
| 2,035,766 | A | 3/1936 | Schramm, Jr. | |

(Continued)

FOREIGN PATENT DOCUMENTS

| | | |
|---|---|---|
| EP | 0303593 | 1/1993 |
| JP | 2007092208 A * | 4/2007 |
| JP | 2009-24266 | 2/2009 |

OTHER PUBLICATIONS

JP 2009024266 (Okura) Pub. Feb. 5, 2009, English language machine translation (EPO), description and claims, 6 pages.*

*Primary Examiner* — Amy Vanatta
(74) *Attorney, Agent, or Firm* — Boyle Fredrickson, S.C.

(57) ABSTRACT

A garment, such as a shirt, adapted to be worn on the upper body of a user includes a pair of adjacent front panels. Each panel terminates in an edge area and defines an upper neck area positioned in front of the neck of the user when the garment is worn. A closed passage is provided in each front panel adjacent the edge area of the front panel, and extends downwardly from the upper edge area of the front panel. A stiffener member is contained within each passage, and extends into the upper neck area of the front panel and downwardly therefrom within the closed passage so as not to be removable from within the passage. The stiffener members are configured and arranged so as to maintain the upper neck areas of the adjacent front panels apart from each other when the garment is worn.

16 Claims, 12 Drawing Sheets

(56) References Cited

U.S. PATENT DOCUMENTS

| | | | | | |
|---|---|---|---|---|---|
| 2,373,594 | A | * | 4/1945 | Pecker | 2/266 |
| 2,401,157 | A | | 5/1946 | Hirsch | |
| 2,467,117 | A | | 4/1949 | Dukes, Jr. | |
| 2,560,157 | A | * | 7/1951 | Cohn | 2/132 |
| 2,595,133 | A | | 4/1952 | Golden | |
| 2,599,636 | A | | 6/1952 | Hull | |
| 2,607,921 | A | * | 8/1952 | Jones | 2/128 |
| 2,627,605 | A | | 2/1953 | Nichols | |
| 2,740,125 | A | | 4/1956 | Spevak | |
| 2,780,816 | A | * | 2/1957 | Saltzman | 2/128 |
| 2,795,795 | A | | 6/1957 | Hobbs | |
| 2,836,827 | A | | 6/1958 | Montero | |
| 2,884,640 | A | | 5/1959 | Liebowitz | |
| 3,261,068 | A | * | 7/1966 | Gurney | 24/695 |
| 3,363,263 | A | * | 1/1968 | Blue | 2/116 |
| 3,629,866 | A | * | 12/1971 | Blue | 2/132 |
| 4,616,366 | A | | 10/1986 | Mueller | |
| 6,089,422 | A | | 7/2000 | Gibson | |
| D507,205 | S | | 7/2005 | Bier et al. | |
| 8,001,619 | B1 | | 8/2011 | Baehring | |
| 8,407,817 | B2 | | 4/2013 | Behrens | |
| D681,921 | S | | 5/2013 | Franklin | |
| D681,922 | S | | 5/2013 | Franklin | |
| D681,923 | S | | 5/2013 | Franklin | |
| D681,924 | S | | 5/2013 | Franklin | |
| 2005/0160520 | A1 | | 7/2005 | Forrest | |
| 2008/0295214 | A1 | * | 12/2008 | Krauss | 2/60 |
| 2009/0019619 | A1 | | 1/2009 | Shweky | |
| 2009/0038049 | A1 | | 2/2009 | West | |
| 2010/0313331 | A1 | | 12/2010 | English | |
| 2011/0173740 | A1 | | 7/2011 | Franklin | |
| 2012/0278973 | A1 | | 11/2012 | Berkowitz et al. | |
| 2014/0173809 | A1 | * | 6/2014 | Partsch, IV | 2/255 |

* cited by examiner

PLACKET STIFFENER ARRANGEMENT FOR A GARMENT SUCH AS A SHIRT

CROSS-REFERENCE TO RELATED APPLICATIONS

This application claims priority to U.S. provisional application Ser. No. 61/890,929, filed Oct. 15, 2013, the entire contents of which is incorporated herein by reference.

BACKGROUND AND SUMMARY

The present invention relates in general to a garment such as a shirt, jacket or the like, and more particularly to a stiffener arrangement for use in a garment such as a shirt or jacket.

In a garment such as a shirt, it is known to join adjacent panels together using closures such as buttons, snaps, etc. In a button-down collar-type shirt, it is common to leave the upper buttons or snaps unfastened, to provide an open collar appearance. However, it is also common for the open upper area of the shirt to crumple or buckle under the weight of collar, which can provide an unattractive, rumpled appearance. While starch can be used to stiffen portions of the shirt, this is not an ideal solution in that the effects of the starch can dissipate over time. In addition, overly starched areas of a garment can be uncomfortable. There is thus a need for an arrangement that maintains the open upper areas apart from each other and that prevents the open upper areas of the shirt from collapsing.

In accordance with one aspect of the present invention, a garment adapted to be worn on the upper body of a user includes a pair of adjacent front panels, each of which terminates in an edge area and defines an upper neck area positioned in front of the neck of the user when the garment is worn by the user. A closed passage is provided in each front panel adjacent the edge area of the front panel, and extends downwardly from the upper edge area of the front panel. A stiffener member is contained within each passage, and extends into the upper neck area of the front panel and downwardly therefrom within the closed passage so as not to be removable from within the passage. The stiffener members are configured and arranged so as to maintain the upper neck areas of the adjacent front panels apart from each other when the garment is worn.

Representatively each closed passage may be defined by a garment placket. A collar having an interior may be located above the upper neck area of each front panel, and the stiffener member is preferably configured to extend into the interior of the collar. The collar may be secured to the upper neck area of each front panel by a series of stitches, and the stitches may extend through the stiffener member. A closure component, such as a button, extends through the interior of the collar, and the stiffener member includes an open area through which the closure component extends.

A closure component, such as a button or snap, may be located adjacent to and spaced inwardly from the edge area of each front panel below the collar, and extends through the closed passage. The stiffener member is positioned between the edge area and the closure component within the passage. In one form, a series of spaced apart closure components are located adjacent to and spaced inwardly from the edge area of each front panel, and the stiffener member extends between a pair of closure components located below the upper neck area of the front panel.

The stiffener member may include a narrowed portion that extends between a first pair of closure components and a widened portion located between a second pair of closure components. The widened portion extends to a location inwardly of the closure components relative to the narrowed portion, and prevents the stiffener member from rolling within the passage.

The invention also contemplates a method of fabricating a garment adapted to be worn on the upper body of a user, substantially in accordance with the foregoing summary.

These and other features and aspects of the present invention will be better appreciated and understood when considered in conjunction with the following description and the accompanying drawings It should be understood, however, that the following description, while indicating a representative embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views, and in which.

Figure 1:
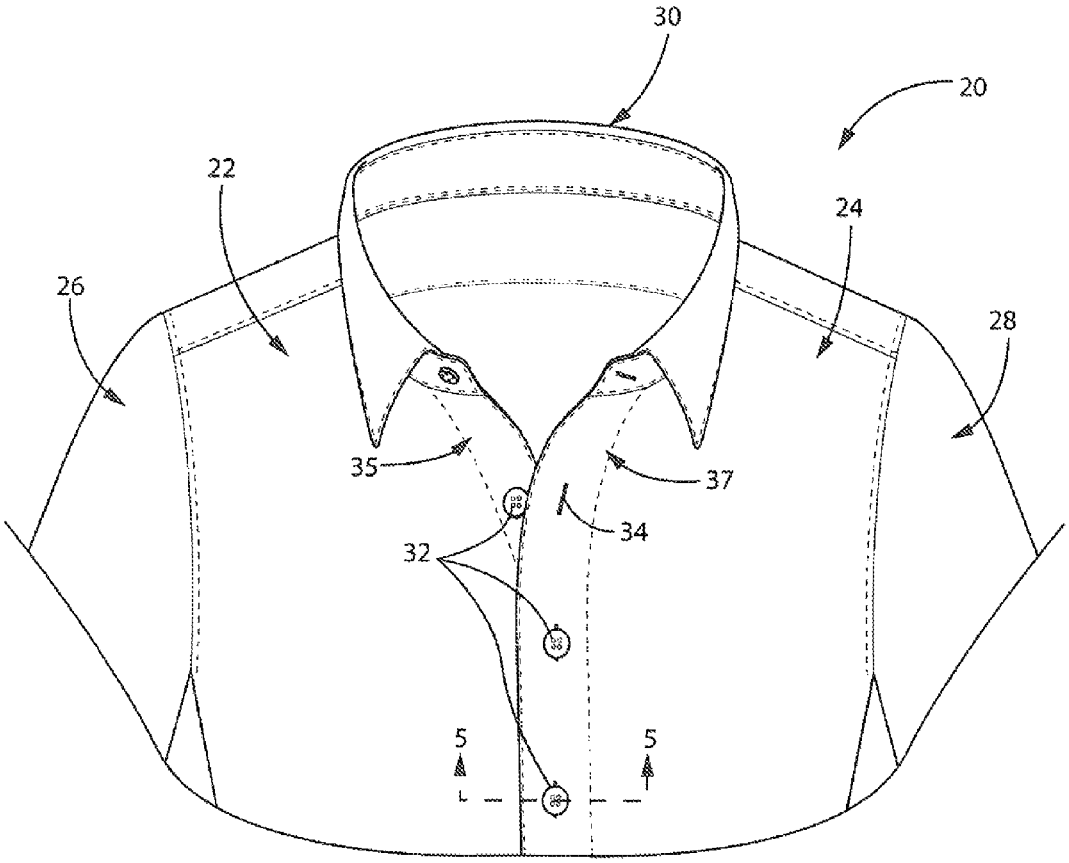
FIG. 1 is a representative partial front elevation view of a garment, in the form of a shirt, incorporating the placket stiffener arrangement of the present invention and showing the adjacent front panels of the shirt buttoned together.

In describing the embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word connected, attached, or terms similar thereto are often used. They are not limited to direct connection but include connection through other elements where such connection is recognized as being equivalent by those skilled in the art.

DETAILED DESCRIPTION

The various features and advantageous details of the subject matter disclosed herein are explained more fully with reference to the non-limiting embodiment described in detail in the following description.

Figure 2:
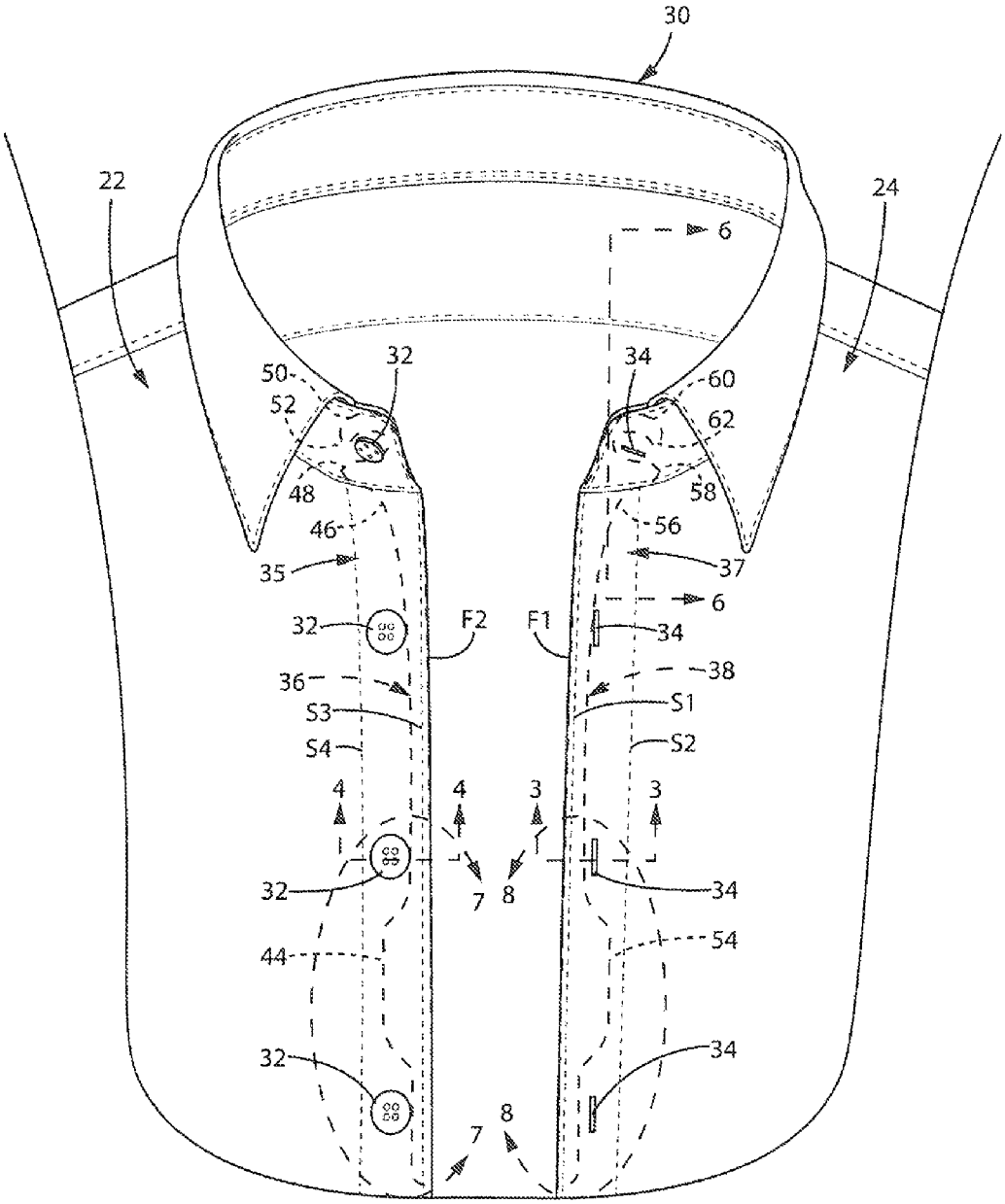
FIG. 2 is an enlarged partial front elevation view of the shirt of FIG. 1, with the adjacent front panels of the shirt unbuttoned.

As shown in FIG. 1, a garment adapted to be worn on the upper body of a user, such as a button-down-type shirt 20, generally includes a pair of body panels 22, 24 and respective sleeves 26, 28. Shirt 20 also includes a collar 30, in a manner as is known, as well as a series of closures which may be in the form of buttons 32 that can be inserted through button holes 34 in order to selectively join body panels 22, 24 together. Buttons 32 may be secured to shirt 20 at a placket 35, which typically extends from the top to the bottom of body panel 22, in a manner as is known. Similarly, button holes 34 may formed in shirt 20 at a placket 37, which typically extends from the top to the bottom of body panel 24, again in a manner as is known FIG. 2 illustrates the upper, central area of shirt 20, and specifically shows a front stiffener arrangement in accordance with the present invention incorporated into the shirt 20. Generally, the front stiffener arrangement includes a button-side stiffener member 36 and a buttonhole-side stiffener member 38 embedded within the fabric of shirt 20 at the adjacent areas of body panels 22, 24, respectively. In a manner to be explained, stiffener members 36, 38 function to maintain the upper area of shirt 20 upright and resist buckling or crumpling, which often can occur under the weight of collar 30 when the upper area of shirt 20 is left open. It is understood that, while shirt 20 is illustrated as having closures in the form of buttons 32 and button holes 34, shirt 20 may have any other type of closure arrangement as desired, such as snaps, grippers, hook-and-loop closures, a zipper, etc.

Figure 3:
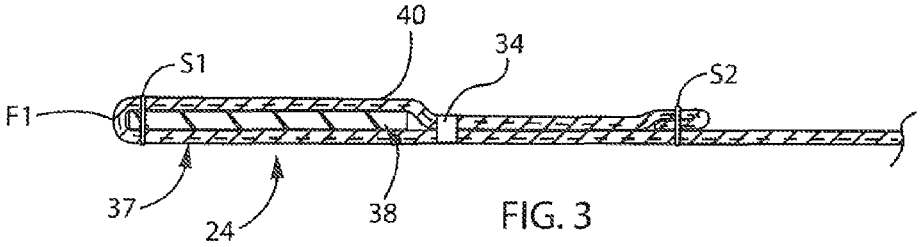
FIG. 3 is a partial section view taken along line 3-3 of FIG. 2.

FIG. 3 illustrates the manner in which buttonhole-side stiffener member 38 is positioned within shirt 20. In a typical construction, the body panel 24 of shirt 20 is folded at F1 in order to form the inner edge of body panel 24. The inner area of the fabric of body panel 24 forms an inner flap 40. A stitch line, shown at S1, may secure flap 40 to body panel 24 adjacent fold F1, to form the outer extent of placket 37. Button holes 34 are formed through the overlapping areas of body panel 24 and inner flap 40 inwardly of stitch line S1. Buttonhole-side stiffener 38 is positioned between the button holes 34 and the fold F1, and specifically between the button holes 34 and the stitch line S1, where the overlapping areas of body panel 24 and flap 40 form a tunnel defined between button holes 34 and fold F1 that extends top to bottom throughout the height of body panel 24. A stitch line, shown at S2, may secure the end of inner flap 40 to front panel 24 on the opposite side of button holes 34 to form the inner extent of placket 37. Alternatively, one or both of stitch lines S1, S2 may be eliminated to provide a placket-less construction. In such a construction, the inner end of flap 40 may simply be unsecured to panel 24 or may be secured to panel 24 via an adhesive or the like.

Figure 4:
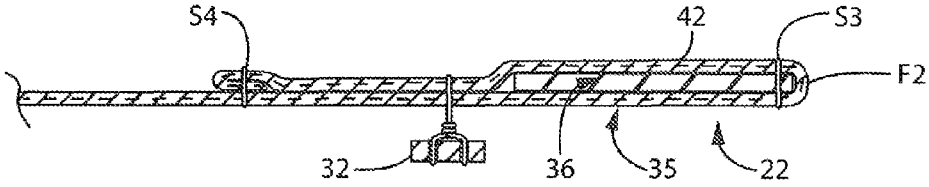
FIG. 4 is a partial section view taken along line 4-4 of FIG. 2.

FIG. 4 illustrates the manner in which button-side stiffener member 36 is positioned within shirt 20. In a typical construction, the body panel 22 of shirt 20 is folded at F2 in order to form the inner edge of body panel 22. The inner area of the fabric of body panel 22 forms an inner flap 42. A stitch line, shown at S3, may secure flap 42 to body panel 22 adjacent fold F2, to form the outer extent of placket 35. Buttons 32 are secured by stitches through the overlapping areas of body panel 22 and inner flap 42 inwardly of stitch line S3. Button-side stiffener 36 is positioned between the buttons 32 and the fold F2, and specifically between the buttons 32 and the stitch line S3, where the overlapping areas of body panel 22 and flap 42 form a tunnel defined between buttons 32 and fold F2 that extends top to bottom throughout the height of body panel 22. A stitch line, shown at S4, may secure the end of inner flap 42 to front panel 22 on the opposite side of buttons 32 to form the inner extent of placket 35. Alternatively, one or both of stitch lines S3, S4 may be eliminated to provide a placket-less construction. In such a construction, the inner end of flap 42 may simply be unsecured to panel 22 or may be secured to panel 24 via an adhesive or the like.

Figure 5:
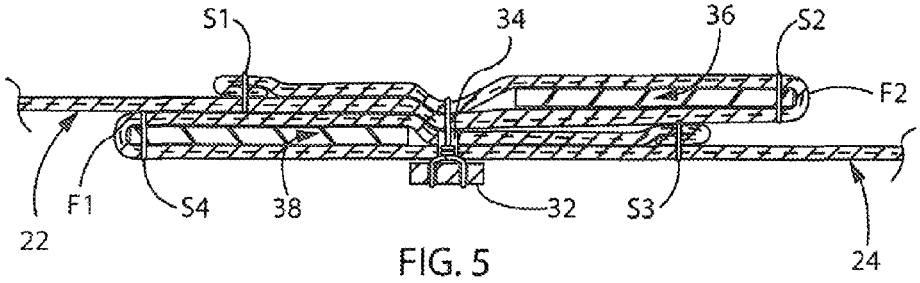
FIG. 5 is a partial section view taken along line 5-5 of FIG. 1.

FIG. 5 shows front panels 22 and 24 in overlapping relationship, with button 32 having been inserted through button hole 34 so as to secure front panels 22 and 24 together.

Figure 7:
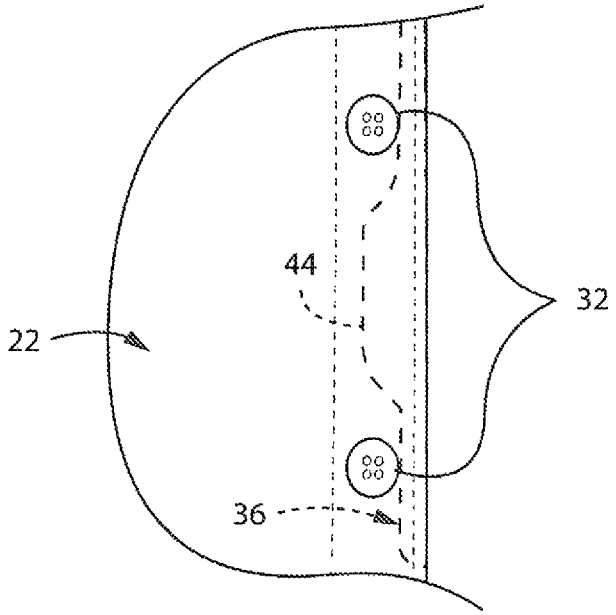
FIG. 7 is an enlarged partial elevation view with reference to line 7-7 of FIG. 2.

Referring to FIG. 2, button-side stiffener 36 is has a relatively narrow width throughout the majority of its length. Representatively, stiffener 36 may have a length that extends from collar 30 downwardly past the third or fourth buttons 32 from the top, although it is understood that stiffener 36 may have any length as desired. Generally, the narrow width of stiffener 36 enables it to be positioned within the space between the stitches of buttons 32 and the inside extent of the placket 35, represented by stitch line S1 in FIG. 3. It has been found, however, that the relatively narrow width of stiffener 36 creates a tendency for the lower area of stiffener 36 to roll within the tunnel defined by placket 35. To prevent such rolling, stiffener 36 is formed with at least one widened anti-roll tab 44 (FIGS. 2, 7), which is positioned between a pair of adjacent buttons 32. Anti-roll tab 44 has a width that exceeds half of the width of the tunnel defined by placket 35, and preferably has a width that is approximately 75% of the width of the placket tunnel. The width of anti-roll tab 44 thus prevents stiffener 36 from rolling within the placket tunnel during a laundering or cleaning operation. While a single anti-roll tab 44 is illustrated, it can be appreciated that additional similar anti-roll tabs may be provided if desired. In addition, while anti-roll tab 44 is shown as having a generally trapezoidal shape when viewed in plan, it can be appreciated that anti-roll tab 44 may have any other configuration as desired.

Still referring to FIG. 2, button-side stiffener 36 has an outwardly flared portion 46 above the topmost front panel button 32. Above outwardly flared portion 46, the upper end of button-side stiffener 36 defines a generally hook-shaped upper end including a lower finger 48 and an upper finger 50, between which a recess 52 is defined. The upper end of stiffener 36 extends into and is contained within the interior of collar 30. Recess 52 in the upper end of stiffener 36 accommodates stitches that secure the collar button 32 to the collar 30. With this construction, the stitch line that secures the lower edge of collar 30 to the upper edge of front panel 22 also extends through stiffener 36. In addition, if desired, the stitch line at the upper end of collar 30 may also extend through the very top portion of stiffener 36, or alternatively the top portion of stiffener 36 above the lower collar stitch line may be unsecured at its upper end. This securely affixes the upper end of stiffener 36 in place relative to collar 30 and the upper area of front panel 22.

Figure 8:
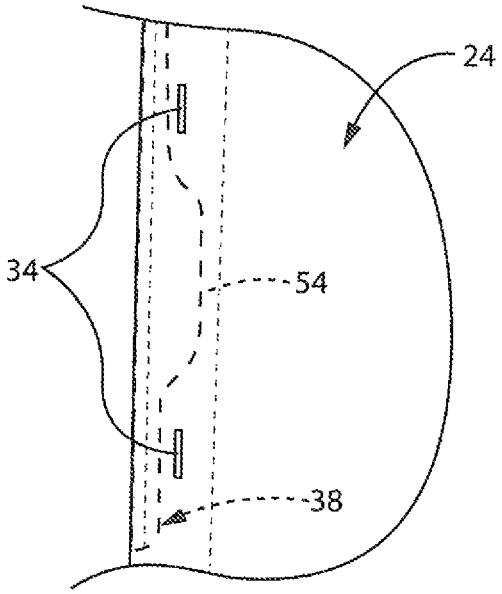
FIG. 8 is an enlarged partial elevation view with reference to line 8-8 of FIG. 2.

Similarly, buttonhole-side stiffener 38 is generally a mirror image of stiffener 46, having a relatively narrow width throughout the majority of its length. Again, stiffener 38 may have a length that extends from collar 30 downwardly past the third or fourth button holes 34 from the top, although it is understood that stiffener 38 may have any length as desired. Generally, the narrow width of stiffener 38 enables it to be positioned within the space between button holes 34 and the inside extent of the placket 37, represented by stitch line S3 in FIG. 4. To prevent rolling at its lower end, stiffener 38 is formed with at least one widened anti-roll tab 54 (FIGS. 2, 8), which is positioned between a pair of adjacent button holes 34. Anti-roll tab 54 has a width that exceeds half of the width of the tunnel defined by placket 37, and preferably has a width that is approximately 75% of the width of the placket tunnel. The width of anti-roll tab 54 thus prevents stiffener 38 from rolling within the placket tunnel during a laundering or cleaning operation. While a single anti-roll tab 54 is illustrated, it can be appreciated that additional similar anti-roll tabs may be provided if desired. In addition, while anti-roll tab 54 is shown as having a generally trapezoidal shape when viewed in plan, it can be appreciated that anti-roll tab 54 may have any other configuration as desired.

Figure 6:
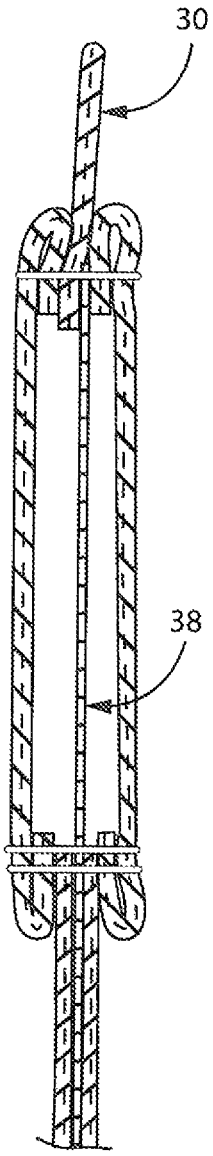
FIG. 6 is a partial section view taken along line 6-6 of FIG. 2.

Still referring to FIG. 2, buttonhole-side stiffener 38 has an outwardly flared portion 56 above the topmost front panel button hole 34. Above outwardly flared portion 56, the upper end of buttonhole-side stiffener 38 defines a generally hook-shaped upper end including a lower finger 58 and an upper finger 60, between which a recess 62 is defined. The upper end of stiffener 38 extends into and is contained within the interior of collar 30. Recess 62 in the upper end of stiffener 38 accommodates button hole 34 that is formed in collar 30. With this construction, the stitch line that secures the lower edge of collar 30 to the upper edge of front panel 22 also extends through stiffener 38, as shown in FIG. 6. In addition, if desired, the stitch line at the upper end of collar 30 may also extend through the very top portion of stiffener 38, or alternatively the top portion of stiffener 38 above the lower collar stitch line may be unsecured at its upper end. The upper end of stiffener 38 is thus secured in place relative to collar 30 and the upper area of front panel 22.

Stiffeners 36, 38 may be constructed of any satisfactory relatively thin, rigid or semi-rigid material that maintains its shape over time and with repeated washings and/or cleanings. Representatively, stiffeners 36, 38 may be formed of a material such as polypropylene in a stamping and forming operation, although other materials such HDPE or nylon may be employed.

It can thus be appreciated that stiffeners 36, 38 may be formed to have a generally flat, planar configuration in the area of front panels 22, 24, respectively, that overlaps the lower buttons 32 and button holes 34, respectively. Toward their upper ends, stiffeners 36, 38 may be provided with an outwardly flared configuration that ensures that the upper areas of front panel 22 and collar 30 maintain an upright orientation and stand out from the user's body, to provide a clean, unrumpled appearance.

Figure 9:
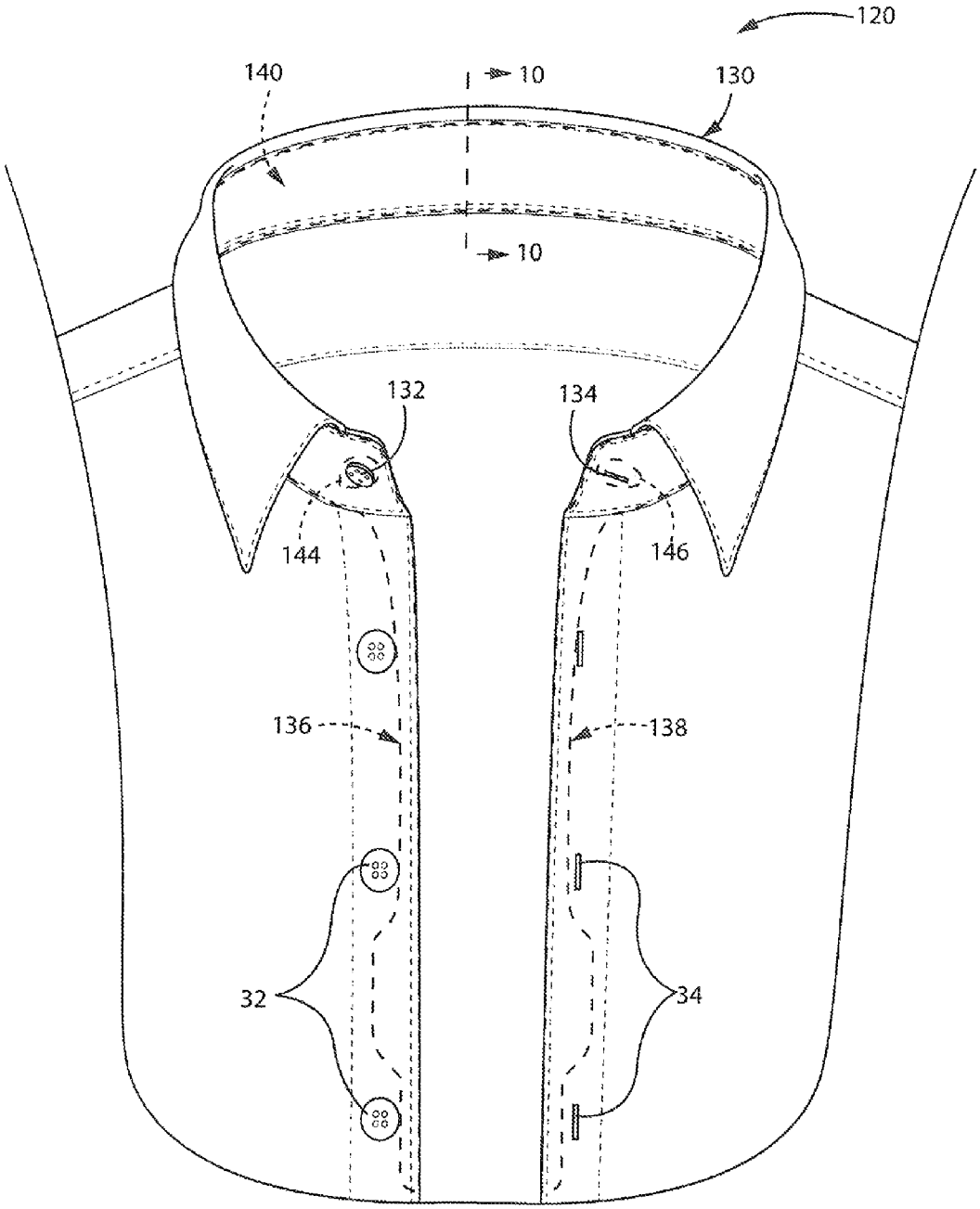
FIG. 9 is a front elevation view similar to FIG. 2, showing an alternative embodiment of the stiffener arrangement of the present invention incorporating a collar stiffener.
Figure 10:
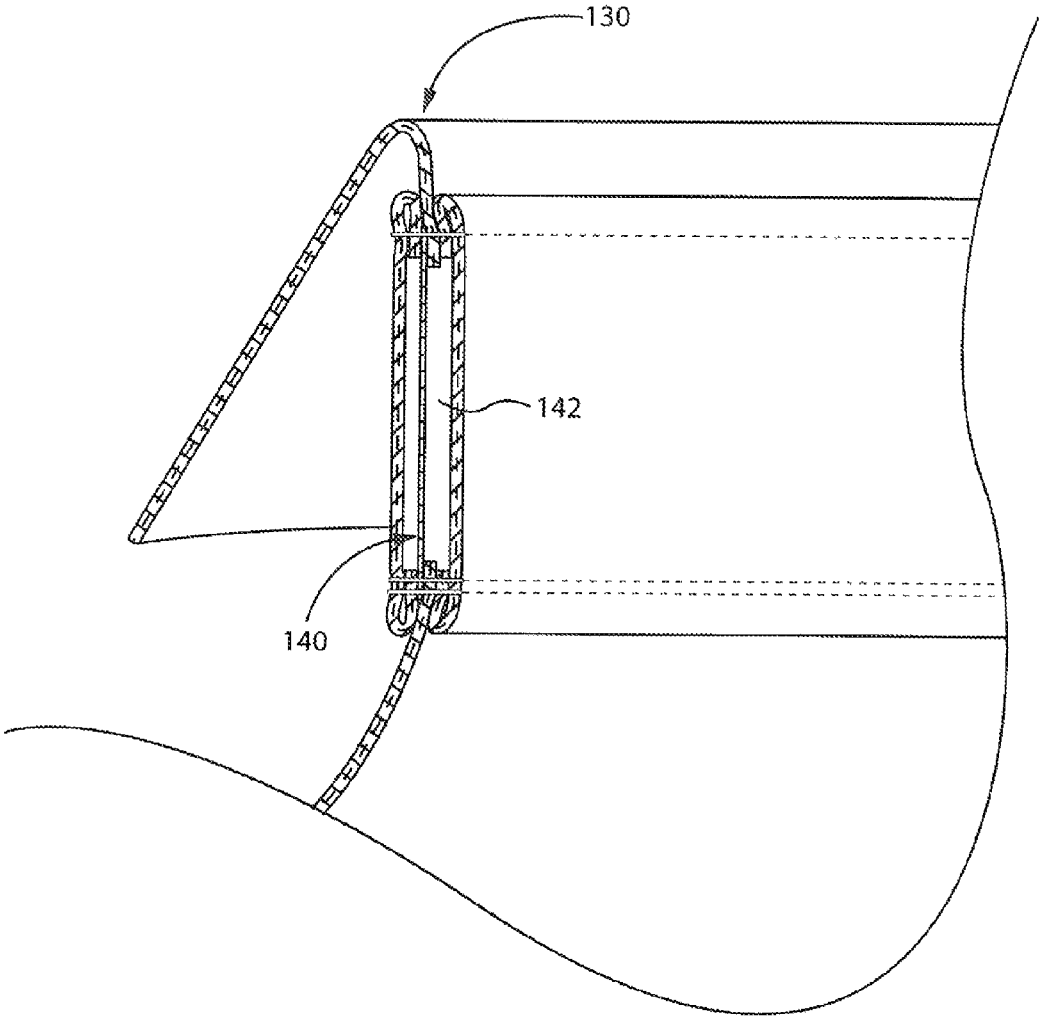
FIG. 10 is a partial section view taken along line 10-10 of FIG. 9.
Figure 11:
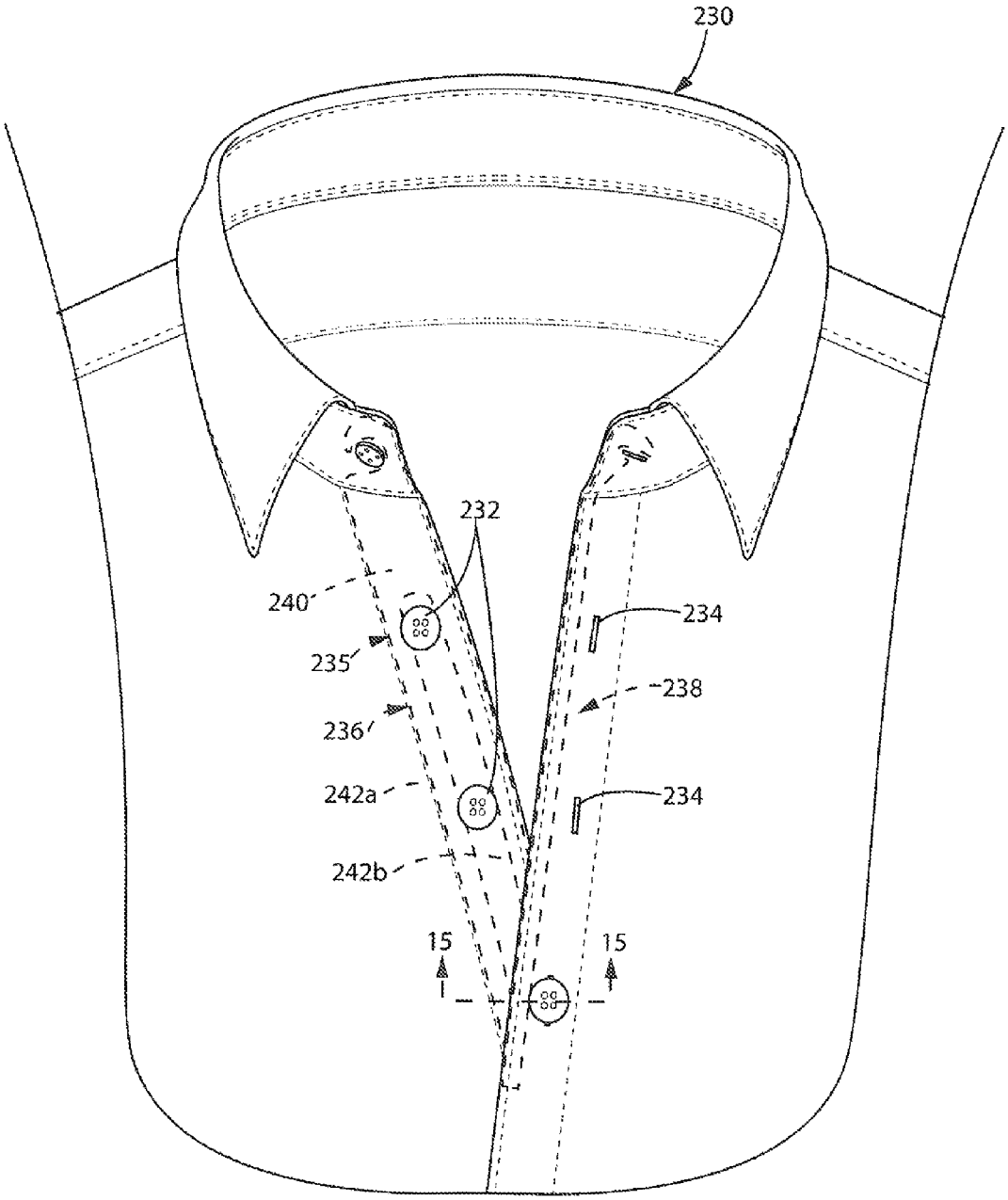
FIG. 11 is a partial front elevation view similar to FIG. 1, showing an alternative embodiment of the placket stiffener arrangement of the present invention.
Figure 12:
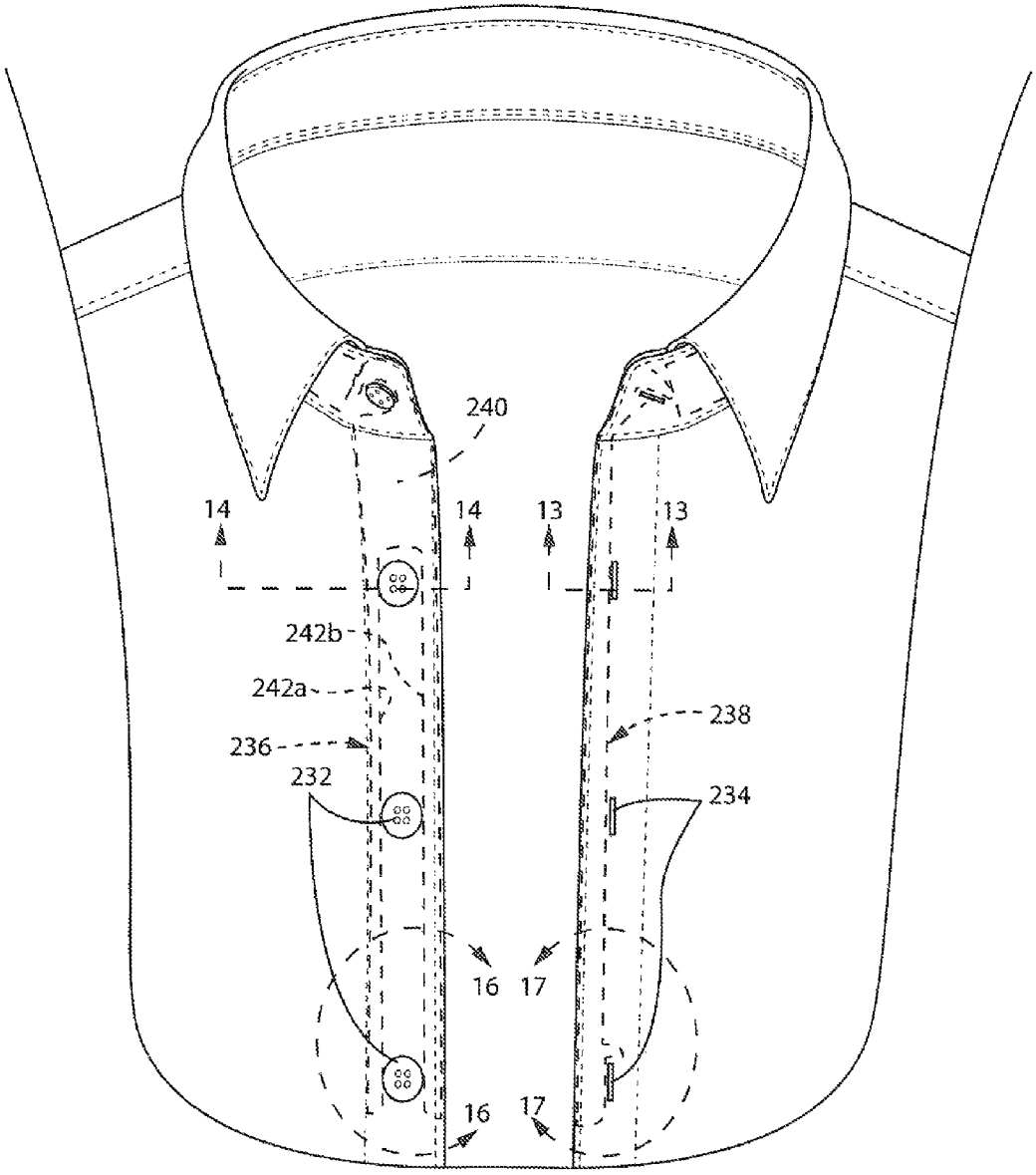
FIG. 12 is a partial front elevation view of the garment of FIG. 11, showing the adjacent front panels of the shirt unbuttoned.
Figure 13:
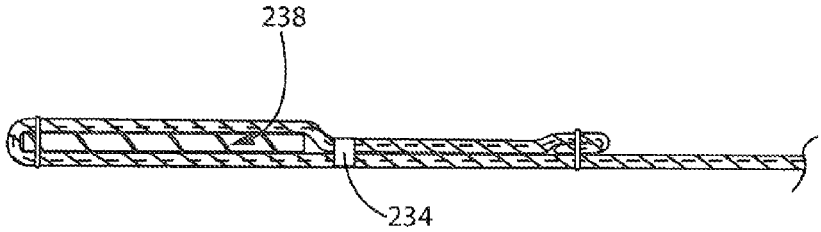
FIG. 13 is a partial section view taken along line 13-13 of FIG. 12.
Figure 14:
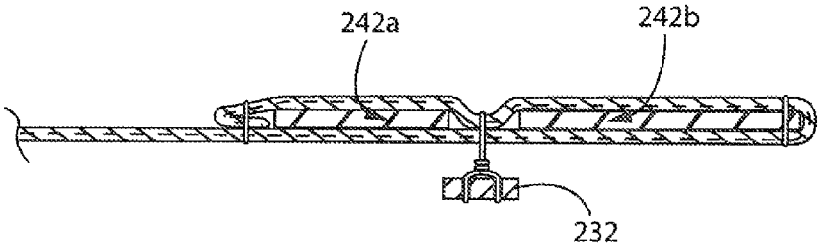
FIG. 14 is a partial section view taken along line 14-14 of FIG. 12.
Figure 15:
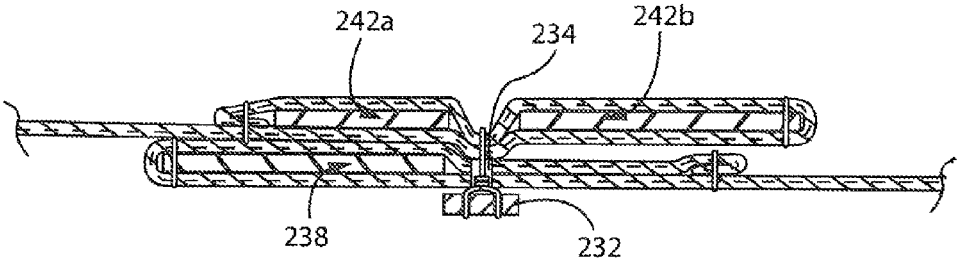
FIG. 15 is a partial section view taken along line 15-15 of FIG. 11.

FIGS. 9 and 10 illustrate a garment in the form of a shirt 120 having an alternative stiffener arrangement in accordance with the present invention, including placket stiffeners 136 and 138 that are configured similarly to placket stiffeners 36, 38, respectively, and that are incorporated into shirt 120 in a similar manner. In this embodiment, shirt 120, which has a collar 130, also includes a collar stiffener 140 integrated into collar 130. Collar stiffener 140 is positioned within an internal passage, shown at 142, defined by collar 130. Collar stiffener 140 may be stitched into the collar 130, or alternatively may simply have a width that enables it to be slid into the collar passage 142 after collar 130 is constructed. The front ends of collar stiffener 140 have openings 144, 146, which accommodate button 132 and button hole 134, in a manner similar to that described previously with respect to stiffeners 36, 38, respectively. Collar stiffener 140 has a flexible arcuate configuration, which enables the topmost button 132 and the topmost buttonhole 134 to be buttoned if desired, and which also functions to spread the topmost area of shirt 120 apart when the topmost button 312 and topmost buttonhole 134 are unbuttoned.

FIGS. 11-16 illustrate alternative configurations of the button-side and button-hole side stiffeners, shown at 236, 238, respectively.

In this embodiment, button-side stiffener 236 may be configured to include a generally full-width upper portion 240 and a pair of leg portions 242*a* and 242*b* that extend downwardly from upper portion 240 and that are separated by a space. Legs 242*a* and 242*b* come together at an upper end area that defines the lower extent of upper portion 240, which may be configured to rest on the stitches that maintain the upper button 232 in place on placket 235. In this manner, button-side stiffener 236 is secured against slipping vertically within the passage of placket 35. If desired, the upper end of stiffener 236 may extend into the passage of collar 230 and have a similar configuration and operation as described previously with respect to stiffener 36.

Figure 16:
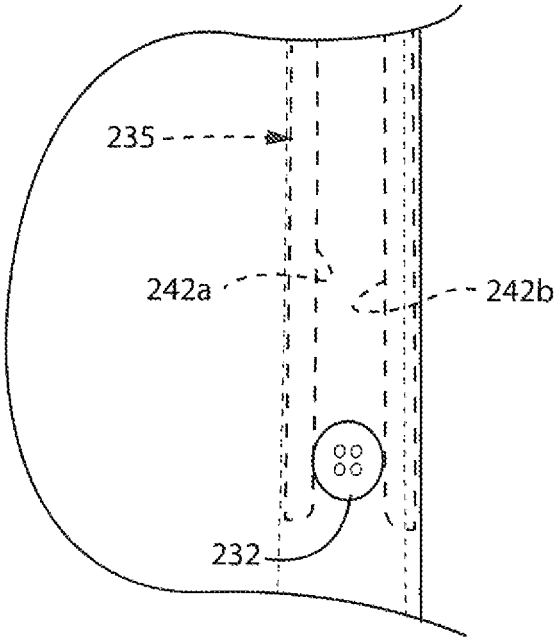
FIG. 16 is an enlarged partial elevation view with reference to line 16-16 of FIG. 12.

FIG. 16 shows the lower end of button-side placket stiffener 236, and specifically illustrates the lower ends of legs 242*a* and 242*b*. Representatively, legs 242*a* and 242*b* may be positioned to extend just below one of the buttons 232 below the upper button 32 adjacent the upper ends of legs 242*a* and 242*b*. For example, button-side placket stiffener 236 may have a length that is sufficient to position the lower ends of legs 242*a* and 242*b* below the fourth button from the top, although it is understood that any other length of button-side placket stiffener 236 may be employed. For example, stiffener 236 may have a length sufficient to extend only to the second or third button down from the top. The overall width of button-side placket stiffener 236 is generally similar to the width of the passage of placket 235 so that the horizontal position of button-side placket stiffener 236 is maintained.

Figure 17:
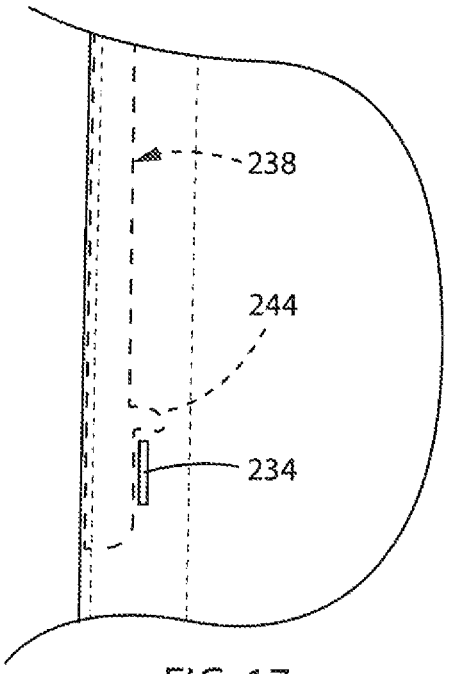
FIG. 17 is an enlarged partial elevation view with reference to line 17-17 of FIG. 12.

FIG. 17 shows the lower end of buttonhole-side placket stiffener 238, and specifically illustrates a catch finger 244 which is adapted to fit around the stitches at the upper end of one of button holes 234. The lower end of buttonhole-side stiffener 238 below finger 244 has a width corresponding to the internal passage or tunnel defined between fold F1 and buttonhole 234, which functions to maintain catch finger 244 in position over the upper end of buttonhole 234. Again, buttonhole-side stiffener 238 may have a length that is sufficient to position its lower end below the fourth buttonhole from the top, although it is understood that any other length of buttonhole-side stiffener 238 may be employed. For example, stiffener 238 may have a length sufficient to extend only to the second or third buttonhole down from the top.

It is contemplated that the button-side stiffener, such as 36, 236, and the buttonhole-side stiffener, such as 38, 238, may be incorporated into shirt 20 during original fabrication. In this manner, the stiffeners are not removable and remain in place at all times.

Figure 18:
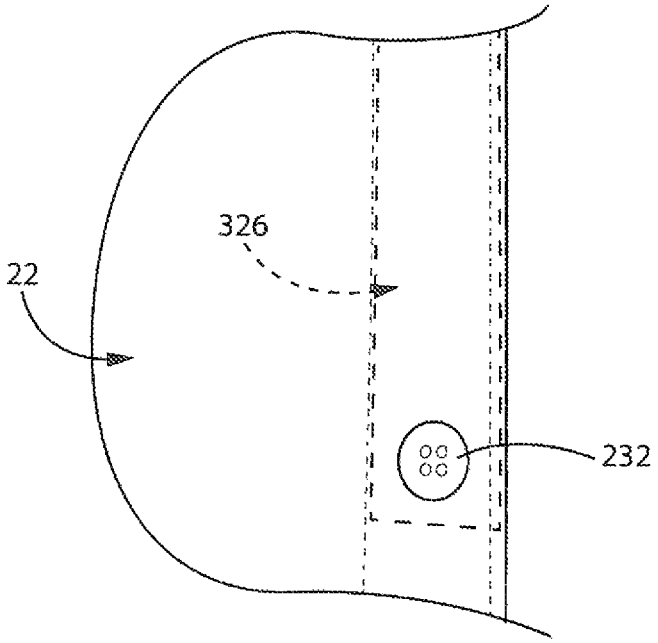
FIG. 18 is a view similar to FIG. 16, showing an alternative embodiment of a button side placket stiffener in accordance with the present invention.

FIG. 18 illustrates an alternative embodiment of a button-side placket stiffener in accordance with the present invention, shown at 326. In this embodiment, stiffener 326 is uninterrupted throughout its entire width. Buttons 32 may be stitched directly through the material of stiffener 326, or alternatively stiffener 326 may be formed with holes through which the stitches of button 32 may pass. Either way, the connections of buttons 32 function to maintain stiffener 326 in position.

Figure 19:
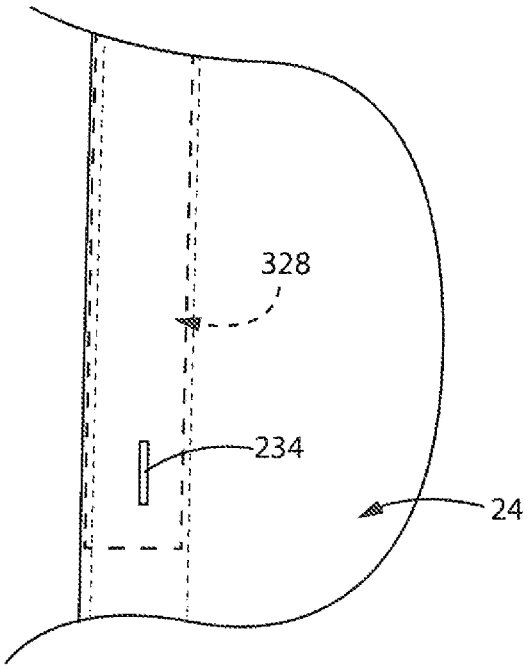
FIG. 19 is a view similar to FIG. 17, showing an alternative embodiment of a buttonhole-side placket stiffener in accordance with the present invention.

Similarly, FIG. 19 illustrates an alternative embodiment of a buttonhole-side stiffener in accordance with the present invention, shown at 328. In this embodiment, stiffener 328 has a width that extends from fold F1 past buttonholes 34. Again, buttonholes 34 may be formed directly through the material of stiffener 328 or stiffener 328 may be formed with holes that accommodate the formation of buttonholes 34. Again, engagement between buttonholes 34 and stiffener 328 functions to maintain stiffener 328 in position It is also contemplated that the stiffeners may be applied to the shirt 20 in a retrofit manner. In an arrangement such as this, a stiffener 36 is positioned between a retrofit panel and the inside of each placket. Representatively, the stiffener has a width that does not interfere with the buttonholes. The retrofit panel is then secured to the back of the placket so as to secure the stiffener in position within a peripherally closed space the corresponds to and is slightly larger than the peripheral configuration of the stiffener. The stiffener preferably is positioned so as to extend up to and behind the collar, as explained previously. The retrofit panel may be secured to the inside surface of the shirt behind the placket in any satisfactory manner, such as by adhesive, stitching, etc.

It should be understood that the invention is not limited in its application to the details of construction and arrangements of the components set forth herein. The invention is capable of other embodiments and of being practiced or carried out in various ways. Variations and modifications of the foregoing are within the scope of the present invention. It also being understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention.

What is claimed is:

1. A garment adapted to be worn on the upper body of a user, comprising:

a pair of adjacent front panels, wherein each front panel terminates in an edge area defining an upper end positioned in front of the neck of the user when the garment is worn by the user;

a closed front passage in each front panel adjacent the edge area of the front panel, wherein each front passage extends downwardly from the upper end of the edge area;

a collar having an internal collar passage, wherein the collar is secured to each front panel by a series of stitches located at the upper end of each front panel below the collar passage; and a stiffener member contained within each front passage, wherein each stiffener member includes a lower portion disposed within one of the front passages and an upper portion that extends upwardly from the upper end of the front panel edge area and that is positioned within the collar passage, wherein the stitches extend through the stiffener member, and wherein the stiffener member is fixed in position by the stitches and is not removable from the passage, and wherein the stiffener members are configured and arranged so as to maintain the front panels apart from each other in front of the neck of the user.

2. The garment of claim 1, wherein at least one of the closed front passages is defined by a garment placket.

3. The garment of claim 1, wherein the collar includes a closure component that extends through the collar passage, and wherein the stiffener member includes an open area through which the closure component extends.

4. The garment of claim 1, wherein a closure component is located adjacent to and spaced inwardly from the edge area of each front panel, wherein the closure component extends through the front passage, and wherein the stiffener member is positioned between the edge area and the closure component within the front passage.

5. The garment of claim 4, wherein a series of spaced apart closure components are located adjacent to and spaced inwardly from the edge area of each front panel, and wherein the stiffener member extends between a pair of closure components located below an upper neck area of the front panel.

6. The garment of claim 5, wherein each stiffener member includes a narrowed portion that extends between a first pair of closure components and a widened portion located between a second pair of closure components, wherein the widened portion extends to a location inwardly of the closure components relative to the narrowed portion to prevent the stiffener member from rolling within the front passage.

7. The garment of claim 1, wherein a collar stiffener member is located within the collar passage.

8. The garment of claim 1, wherein the stiffener member includes a pair of legs separated by a space, wherein each leg is located on one side of one or more closure components that extend through the front passage.

9. A method of fabricating a garment adapted to be worn on the upper body of a user, comprising:

providing a pair of adjacent front panels, wherein each front panel terminates in an edge area that defines an upper end positioned in front of the neck of the user when the garment is worn by the user;

wherein each front panel includes a closed front passage adjacent the edge area of the front panel, wherein each front passage extends downwardly from the upper end of the edge area;

providing a collar having an internal collar passage;

providing a pair of stiffener members, wherein each stiffener member includes a lower portion and an upper portion;

positioning each stiffener member such that the lower portion is disposed within one of the front passages and the upper portion extends upwardly from the upper end of the front panel edge area and is positioned within the collar passage; and securing the collar to the front panels and securing each stiffener member within the front passage via stitches that secure the collar to the front panels and that extend through each stiffener member, wherein each stiffener member is fixed in position by the stitches within the front passage and within the collar passage so as not to be removable therefrom, and wherein the stiffener members are configured and arranged so as to maintain the front panels apart from each other in front of the neck of the user.

10. The method of claim 9, wherein at least one of the front passages is defined by a garment placket in the front panel.

11. The method of claim 9, wherein the collar includes a closure component that extends through the collar passage, and wherein the stiffener member includes an open area through which the closure component extends.

12. The method of claim 9, wherein a closure component is located adjacent to and spaced inwardly from the edge area of each front panel, wherein the closure component extends through the front passage, and further comprising positioning the stiffener member between the edge area and the closure component within the front passage.

13. The method of claim 12, wherein a series of spaced apart closure components are located adjacent to and spaced inwardly from the edge area of each front panel, and further comprising positioning the stiffener member so as to extend between a pair of closure components located below an upper neck area of the front panel.

14. The method of claim 13, wherein each stiffener member includes a narrowed portion that extends between a first pair of closure components and a widened portion located between a second pair of closure components, wherein the widened portion extends to a location inwardly of the closure components relative to the narrowed portion to prevent the stiffener member from rolling within the passage.

15. The method of claim 9, further comprising positioning a collar stiffener member within the collar passage.

16. The method of claim 9, wherein the stiffener member includes a pair of legs separated by a space, wherein the stiffener member is positioned such that each leg is located on one side of one or more closure components that extend through the front passage.

* * * * *